US009565900B2

(12) United States Patent
Lim et al.

(10) Patent No.: US 9,565,900 B2
(45) Date of Patent: Feb. 14, 2017

(54) SHOE SOLE PORTION PAINTING SYSTEM

(71) Applicant: Nike, Inc., Beaverton, OR (US)

(72) Inventors: Hyung Lim, Busan (KR); DongWoo Lee, Busan (KR); DongHoon Lee, Busan (KR); SangWook Jeon, Busan (KR)

(73) Assignee: NIKE, Inc., Beaverton, OR (US)

( * ) Notice: Subject to any disclaimer, the term of this patent is extended or adjusted under 35 U.S.C. 154(b) by 181 days.

(21) Appl. No.: 14/279,588

(22) Filed: May 16, 2014

(65) Prior Publication Data

US 2015/0327630 A1 Nov. 19, 2015

(51) Int. Cl.

| | |
|---|---|
| ***A43D 8/16*** | (2006.01) |
| ***B05D 1/02*** | (2006.01) |
| ***B05D 1/32*** | (2006.01) |
| ***B05B 13/02*** | (2006.01) |
| ***B05B 15/04*** | (2006.01) |
| ***A43D 95/06*** | (2006.01) |
| ***B05B 13/04*** | (2006.01) |

(52) U.S. Cl.

CPC ..... *A43D 8/16* (2013.01); *A43D 95/06* (2013.01); *B05B 13/02* (2013.01); *B05B 13/0431* (2013.01); *B05B 15/045* (2013.01); *B05B 15/0431* (2013.01); *B05B 15/0437* (2013.01); *B05D 1/02* (2013.01); *B05D 1/32* (2013.01)

(58) Field of Classification Search
None
See application file for complete search history.

(56) References Cited

U.S. PATENT DOCUMENTS

2012/0231174 A1 9/2012 Friese

FOREIGN PATENT DOCUMENTS

| | | | |
|---|---|---|---|
| GB | 841838 A | | 7/1960 |
| JP | S6422372 | * | 1/1989 |
| JP | S6422372 A | | 1/1989 |

OTHER PUBLICATIONS

International Search Report with Written Opinion dated Jun. 11, 2015 in Application No. PCT/U52015/019948, 11 pages.

* cited by examiner

*Primary Examiner* — Nathan T Leong
(74) *Attorney, Agent, or Firm* — Shook, Hardy & Bacon L.L.P.

(57) ABSTRACT

Automated painting of a shoe sole portion is enhanced by use of a mask cover and an air knife with a paint assembly. The mask cover is positioned in front of a paint-emitting portion of a spray nozzle and is adapted to obstruct at least a portion of the paint intended to be emitted by the spray nozzle. The air knife is coupled to the mask cover and is adapted to emit a laminar fluid flow over the mask cover. The laminar fluid flow helps to limit unwanted diffusion of the paint as it passes along its intended spray path.

16 Claims, 9 Drawing Sheets

SHOE SOLE PORTION PAINTING SYSTEM

STATEMENT REGARDING FEDERALLY SPONSORED RESEARCH OR DEVELOPMENT

Not applicable.

TECHNICAL FIELD

The aspects hereof relate to a painting system having a paint assembly and a masking assembly. More particularly, the aspects relate to a shoe sole portion painting system having a mask cover and an air knife coupled to a spray nozzle that is adapted to emit a liquid material.

BACKGROUND

Painting a shoe sole portion has traditionally been a labor-intensive process that requires a human operator to manually tape or mask all the areas of the shoe sole portion that are not to be painted. The human operator then manually paints any areas of the shoe sole portion that are left exposed. Once the human operator paints the shoe sole portion, the human operator must then remove the tape or masking agent, clean any overspray, and touch up any defects or gaps in the painted areas. Not only is this process labor-intensive, but it also tends to be wasteful and can produce inconsistent results. Replacing the manual painting process with an automated painting system that is easy-to-use, provides consistent results, reduces waste, and lessens the reliance on a human operator has been challenging.

BRIEF SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Aspects generally relate to an automated shoe sole portion painting system that utilizes a mask cover in combination with an air knife to control the spray path of, for example, paint emitted by a spray nozzle. The mask cover may be coupled to the spray nozzle and positioned in front of the paint-emitting portion of the spray nozzle such that the mask cover intersects or obstructs a portion of the intended spray path of the paint. The mask cover comprises an aperture that extends through the thickness of the mask cover. The aperture may be generally aligned with the paint-emitting portion of the spray nozzle which enables at least some of the paint that may be emitted by the spray nozzle to pass unobstructed through the aperture. A flange may project outwardly from the edges of the aperture. The use of the mask cover helps to control and direct the spray path of the emitted paint and to reduce overspray and/or unwanted paint deflection.

The air knife may be coupled to the mask cover and may be adapted to project or emit a laminar air flow over the mask cover including in the direction of the aperture with its surrounding flange. The flange surrounding the aperture helps to divert the air flow so that paint passing through aperture can continue along its path without being deflected by the air flow. The diverted laminar air flow is directed over the remaining portion of the mask cover where it helps to prevent both lateral and superior deflection of the emitted paint as it passes through the aperture. The air knife augments the control achieved by using the mask cover. The combination of both results in a focused paint spray path with limited deflection and/or unwanted overspray.

In use, the spray nozzle may be coupled to a moving means such as, for example, a robotic arm that moves the spray nozzle through a predetermined range of movement around an object while the spray nozzle emits paint. The use of the mask cover and the air knife with the spray nozzle eliminates the need to manually mask or tape the object being painted.

BRIEF DESCRIPTION OF THE SEVERAL VIEWS OF THE DRAWINGS

The present invention is described in detail below with reference to the attached drawing figures, wherein.

DETAILED DESCRIPTION

Figure 1:
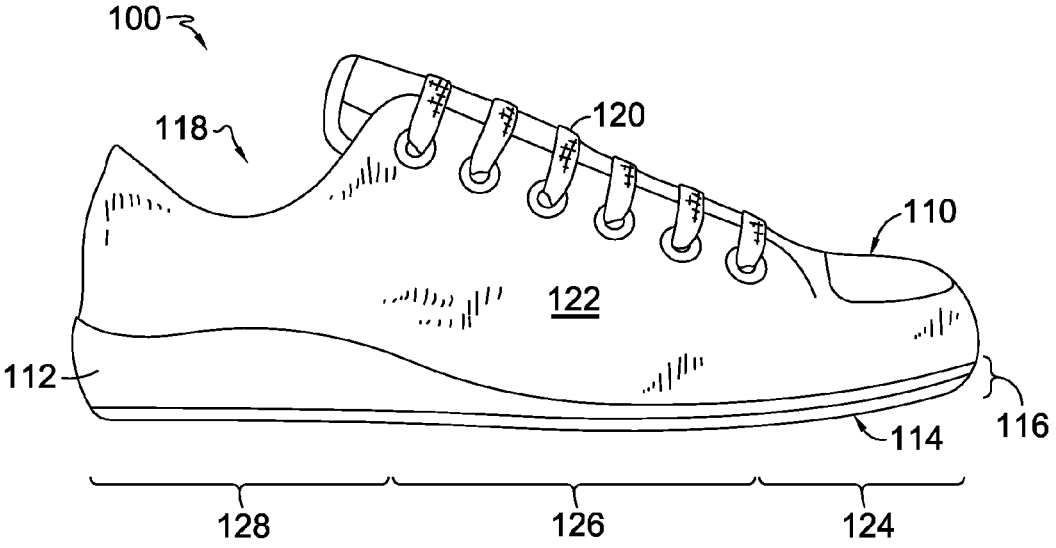
FIG. 1 illustrates a side plan view of an exemplary shoe for reference purposes in accordance with aspects hereof.

Aspects provide for a shoe sole portion painting system for applying a liquid material, such as paint, to an object such as a shoe sole portion. The shoe sole portion painting system in accordance with aspects hereof may comprise a paint assembly comprising at least a spray nozzle having a front port and a back port. The spray nozzle may be fluidly coupled to a liquid material source and may be adapted to emit the liquid material through the nozzle's front port. A hypothetical axis may be drawn from the back port through the front port of the spray nozzle in the intended direction of the liquid material spray path.

The shoe sole portion painting system may further comprise a masking assembly that may be used to control the intended spray path of the liquid material. In an exemplary aspect, the masking assembly may comprise a mask cover that may be moveably or mechanically (the terms "moveably" and "mechanically" may be used interchangeably herein) coupled to the paint assembly. The mask cover may be positioned in front of the front port of the spray nozzle such that the mask cover may be effective to partially obstruct the liquid material intended to be emitted by the spray nozzle. In an exemplary aspect, the mask cover may have an inward-facing surface (e.g., a surface that faces the front port of the spray nozzle), and an outward-facing surface opposite the inward-facing surface (e.g., a surface that faces away from the front port of the spray nozzle). Further, the mask cover may have an aperture that extends from the outward-facing surface through the inward-facing surface. The aperture may be positioned on the mask cover such that the hypothetical axis extending from the back port through the front port of the spray nozzle further extends through the aperture. Further, the aperture may have a surrounding flange that extends substantially perpendicularly outward from the outward-facing surface of the mask cover. The axial alignment along the hypothetical axis of the aperture with the front port of the spray nozzle may be effective to enable a portion of the liquid material intended to be emitted by the front port of the spray nozzle to pass unobstructed through the aperture.

The masking assembly, in an exemplary aspect, may further comprise an air knife that may be mechanically coupled to the mask cover. The air knife may be adapted to project or emit a laminar fluid flow in a generally angled direction over the outward-facing surface of the mask cover and towards the hypothetical axis extending from the back port through the front port of the spray nozzle and continuing through the aperture of the mask cover. The flange surrounding the aperture helps to divert the fluid flow so that the forward movement of the liquid material through the aperture continues generally unimpeded. The flow of the laminar fluid flow over the outward-facing surface of the mask cover, however, helps to limit lateral and superior deflection of the liquid material as it is transmitted through the aperture of the mask cover. The combination of the paint assembly with the masking assembly helps to produce a controlled spray path of the liquid material with the result that the object, such as the shoe sole portion, being painted by the painting system thus described does not have to be manually taped or masked.

FIG. 1 depicts an exemplary shoe 100 that will be described for reference purposes. The shoe 100 comprises an upper 110 and a sole structure 116. The sole structure, in turn, comprises a midsole 112 and an outsole 114. While a separate midsole 112 and outsole 114 are discussed herein, it is contemplated that the sole structure 116 may be formed such that the midsole 112 and the outsole 114 are merely regions of a commonly formed structure. For reference purposes, the shoe 100 may be divided into three general regions or areas: a forefoot or toe region 124, a midfoot region 126, and a heel region 128. The shoe 100 also comprises a lateral side 122 and a medial side (not shown). The lateral side 122 extends along a lateral side of a user's foot and generally comprises the regions 124, 126, and 128. The medial side extends along a medial side of the user's foot and also comprises the regions 124, 126, and 128. The lateral side 122, the medial side, and the regions 124, 126, and 128 are not intended to demarcate specific areas of the shoe 100. Instead, they are intended to represent general areas of the shoe 100 and are used for reference purposes for the following discussion. For example, the medial side and the lateral side 122 may converge near the toe region 124 at respective sides of a toe box. Similarly, it is contemplated that the medial side and the lateral side 122 may also converge at respective sides of an Achilles reinforcement proximate the heel region 128. Therefore, depending on the shoe design and construction, the terms medial, lateral, toe, heel, and the like generally refer to a proximate location and may not be limiting.

The upper 110 is generally secured to the sole structure 116 and defines a cavity for receiving a foot. As mentioned above, the sole structure 116 may comprise the outsole 114 and the midsole 112. The outsole 114 forms a ground-engaging surface of the sole structure 116, and the midsole 112 is generally positioned between the upper 110 and the outsole 114. The outsole 114 and/or the midsole 112 may be formed of conventional materials such as rubber, leather, or a polymer foam material (polyurethane or ethylene vinyl acetate for example). The outsole 114 may be integrally formed with the midsole 112, or the outsole 114 may be attached to a lower surface of the midsole 112. Further, it is contemplated that the midsole 112 may be inserted into a cavity within the outsole 114.

Figure 2:
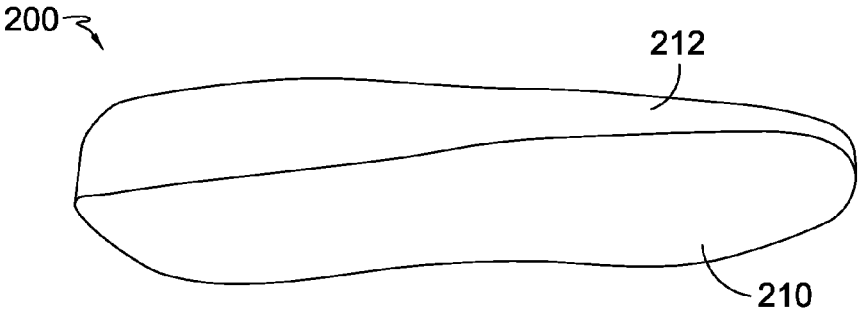
FIG. 2 illustrates a bottom perspective view of an exemplary shoe sole portion for reference purposes in accordance with aspects hereof.

FIG. 2 depicts an exemplary perspective view of a lower surface 210 of a shoe sole portion 200. As used throughout, the term "shoe sole portion" is meant to encompass a midsole portion such as the midsole 112 of FIG. 1, a midsole portion integrally formed with an outsole portion such as the outsole 114 of FIG. 1, and/or an outsole portion without a midsole portion. The lower surface 210 of the shoe sole portion 200 may be adjacent to an outsole when the shoe sole portion comprises a midsole portion, or the lower surface 210 may comprise a ground engaging surface when the midsole is integrally formed with the outsole or when the shoe sole portion comprises an outsole. The shoe sole portion 200 shown in FIG. 2 further comprises a side surface 212. In one aspect, the side surface 212 may comprise a medial side, a lateral side, a heel region, a midfoot region, and a toe region as shown in FIG. 1. In another aspect, the medial and lateral sides of the shoe sole portion 200 may taper as they converge near the toe region such that the side surface 212 may diminish to a negligible thickness near the toe region. Any and all such aspects, and any combination thereof, are contemplated as being within the scope contemplated herein.

Figure 3:
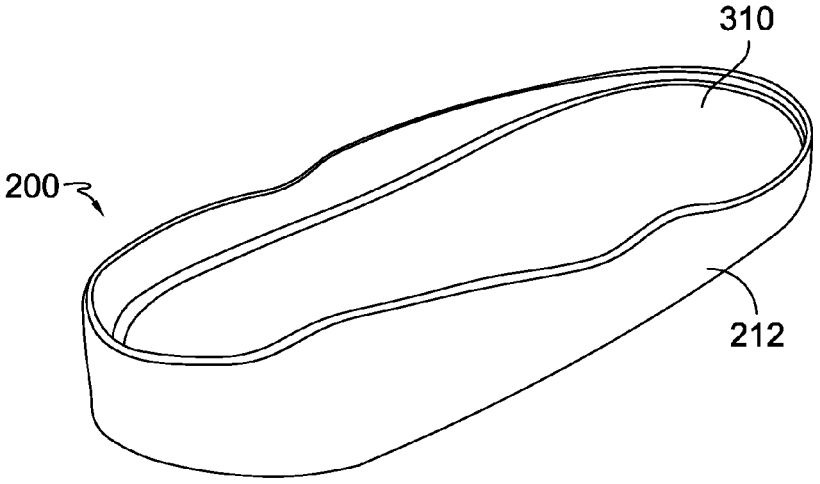
FIG. 3 illustrates a top perspective view of an exemplary shoe sole portion for reference purposes in accordance with aspects hereof.

FIG. 3 depicts an exemplary perspective view of an upper surface 310 of the shoe sole portion 200. The upper surface 310 of the shoe sole portion 200 may be adjacent to an upper, such as the upper 122 of FIG. 1, when the shoe is in an as-constructed arrangement. As shown in FIG. 3, the side surface 212 in combination with the upper surface 310 form at least a partial concavity into which a wearer's foot may partially reside when the shoe is in an as-constructed arrangement.

Figure 4:
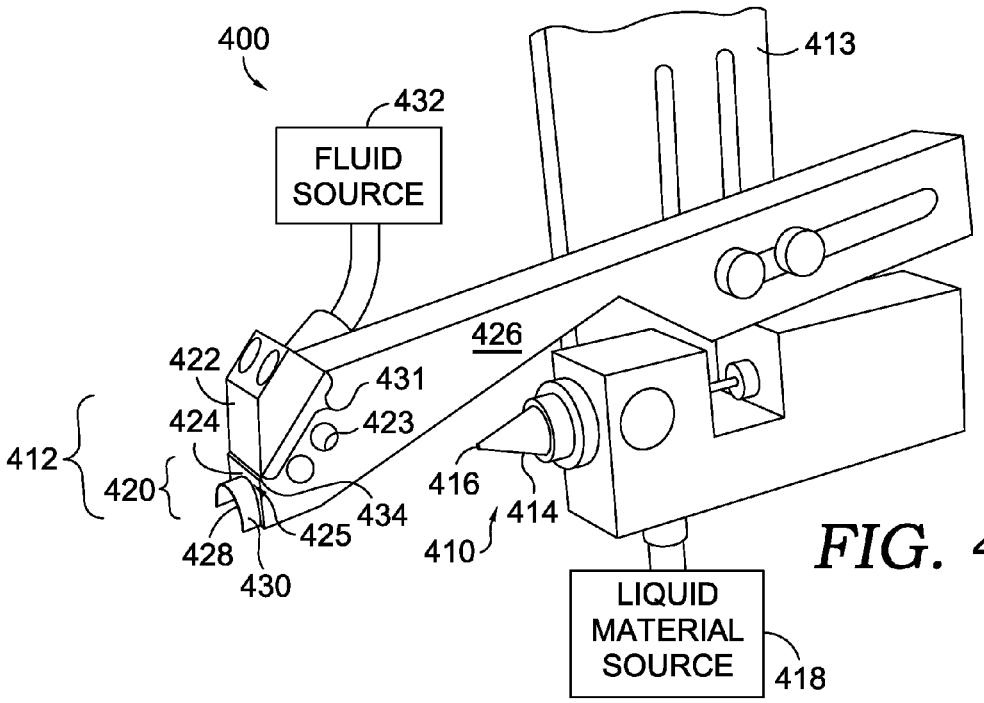
FIG. 4 illustrates a side perspective view of an exemplary shoe sole portion painting system depicting a paint assembly and a masking assembly for reference purposes in accordance with aspects hereof.

Turning now to FIG. 4, an exemplary side perspective view of a shoe sole portion painting system 400 is illustrated in accordance with aspects provided herein. The shoe sole portion painting system 400 may generally comprise a paint assembly 410 and a masking assembly 412. In an exemplary aspect, the paint assembly 410 may comprise at least a spray nozzle 414 having a front port 416 and a back port (not shown in FIG. 4). In an exemplary aspect, the front port 416 of the spray nozzle 414 may have a relatively small orifice adapted to focus liquid material intended to be emitted through the front port 416 in a relatively tight spray pattern. In an additional exemplary aspect, the front port's orifice may be encircled by a flange that further focuses the liquid material intended to be emitted through the front port 416. Other components of the paint assembly 410 are generally known in the art and, as such, will not be described in further detail herein. As mentioned, the spray nozzle 414 may be adapted to project or emit a liquid material from the front port 416. As such, the spray nozzle 414 may be fluidly coupled to a liquid material source 418. As used throughout this disclosure, the term "liquid material" is meant to encompass liquids such as, for example, marking materials such as paints and/or dyes, as well as other types of liquids used in manufacturing processes such as adhesives, solvents, masking agents, bonding agents, and the like.

Although not shown in FIG. 4, the spray nozzle 414 may further be coupled to a moving mechanism. Exemplary moving mechanisms contemplated herein, may comprise a human operator, a robotic arm, and other types of actuators. In an exemplary aspect, the robotic arm may be programmed to move the paint assembly 410 through a predetermined range of movement around an object. The robotic arm may be programmed using, for instance, data from a computer-assisted-design (CAD) model of the object. As well, the robotic arm may be programmed using vision coordinates obtained from the object. Other ways of programming the robotic arm that are known in the art are also contemplated as being within the scope contemplated herein. As used throughout this disclosure, the term "object" is meant to encompass any type of two- or three-dimensional object to which a liquid material can be applied. One example of an object comprises a shoe sole portion such as, for example, the shoe sole portion 200 of FIGS. 2 and 3.

In an exemplary aspect, the masking assembly 412 of the shoe sole portion painting system 400 may comprise a mask cover 420 and an air knife 422. The masking assembly 412 may be mechanically coupled to the paint assembly 410 via, for example, coupling technologies such as screws, bolts, rivets, welding, and the like. Further, the masking assembly 412 may be directly mechanically coupled to the paint assembly 410, or the masking assembly 412 may be indirectly mechanically coupled to the paint assembly 410. For instance, the masking assembly 412 may be secured to a vertically-aligned plate 413 using screws, bolts, rivets, welding, and the like. In turn, the vertically-aligned plate 413 may be mechanically coupled to the paint assembly 410 using screws, bolts, rivets, welding, and the like. Any and all such aspects, and any variation thereof, are contemplated as being included within the scope contemplated herein.

In an exemplary aspect, the mask cover 420 may comprise a front plate 424 and an arm 426. In an exemplary aspect, the front plate 424 and the arm 426 may comprise a single construction. In another exemplary aspect, the front plate 424 may be mechanically coupled to the arm 426 using coupling technologies discussed herein. The arm 426 may be directly or indirectly mechanically coupled to the paint assembly 410 as discussed above. The designation of a "front plate" and an "arm" of the mask cover 420 are not meant to be limiting or to imply a rigid division between these two components. For example, the front plate 424 may be considered an "arm" as it extends in the direction of the paint assembly 410. In an exemplary aspect, the front plate 424 may comprise an angled portion 431 that angles towards and transitions the front plate 424 into the arm 426.

The front plate 424 of the mask cover 420 may comprise an outward-facing surface 425 (seen in FIG. 4), and an inward-facing surface which will be discussed below. The outward-facing surface 425 of the front plate 424 faces away from the front port 416 of the spray nozzle 414, while the inward-facing surface of the front plate 424 faces towards the front port 416 of the spray nozzle 414. The front plate 424 may be positioned generally in front of the front port 416 of the spray nozzle 414. In an exemplary aspect, the front plate 424 may be positioned from 1.0 to 2.0 centimeters in front of the front port 416, from 1.4 to 1.8 centimeters in front of the front port 416, or between 1.6 to 1.7 centimeters in front of the front port 416.

In an exemplary aspect, the front plate 424 of the mask cover 420 may comprise an aperture 428 that extends from the outward-facing surface 425 of the front plate 424 through the inward-facing surface of the front plate 424. The aperture 428 will be explained in greater depth below. As shown in FIG. 4, and in an exemplary aspect, the aperture 428 may be surrounded by a flange 430 that extends generally perpendicularly outward a short distance (e.g., from 0.5 to 4 mm) from the outward-facing surface 425 of the front plate 424.

In an exemplary aspect, the air knife 422 of the masking assembly 412 may be coupled to a top or upper region of the front plate 424. In other words, the air knife 422 may be coupled to an area of the front plate 424 that may be vertically above and adjacent to the aperture 428 as shown in FIG. 4. To put it yet another way, the air knife 422 may be coupled to the angled portion 431 of the mask cover 420. As used throughout this disclosure, terms such as "top," "bottom," "upper," "lower," and the like are considered relative terms for use in illustrating various aspects of the shoe sole portion painting system 400. In practice, the various components and/or parts of the shoe sole portion painting system 400 may be spatially oriented in any manner relative to the environment. The air knife 422 may be mechanically coupled to the mask cover 420 through various coupling technologies such as screws, bolts, rivets, welding, and the like as indicated by, for example, numeral 423.

The air knife 422 may be fluidly coupled to a fluid source 432. As used throughout this disclosure, the term "fluid" when used in connection with the air knife 422 is meant to encompass any type of pressurized gas or fluid such as, for example, carbon dioxide, water, oxygen, ambient air, and the like. The air knife 422 may be adapted to project or emit a pressurized laminar fluid flow through a fluid flow emitting portion 434. As shown in FIG. 4, the air knife 422 may be positioned on the angled portion 431 of the mask cover 420. Thus, when the air knife 422 emits the laminar fluid flow, the laminar fluid flow exits the fluid flow emitting portion 434 in a generally angled direction over the outward-facing surface 425 of the front plate 424. More specifically, in an exemplary aspect, the fluid flow emitting portion 434 may be adapted to direct the laminar fluid flow towards the aperture 428 with its surrounding flange 430 and towards a bottom region or margin of the front plate 424. In an exemplary aspect, the fluid flow emitting portion 434 may measure between 0.1 to 0.5 millimeters. The pressure of the laminar fluid flow emitted by the air knife 422 may be fixed in one exemplary aspect, or the pressure may be variable in another exemplary aspect. Pressures may vary between generally 1 to 6 bar (equivalent to generally 100,000 to 600,000 Pa).

Figure 5:
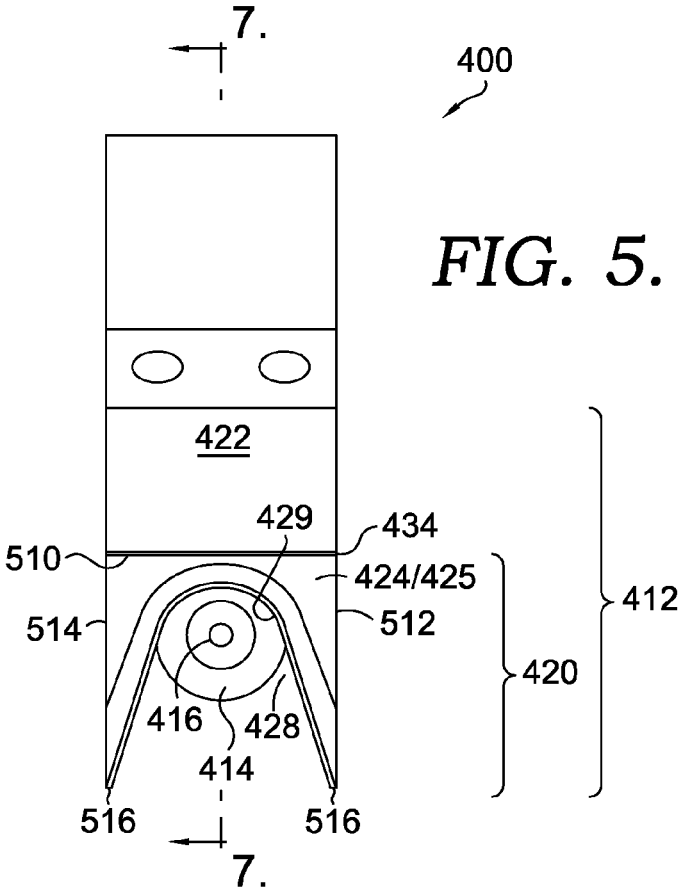
FIG. 5 illustrates a front plan view of an exemplary masking assembly of a shoe sole portion painting system for reference purposes in accordance with aspects hereof.

Turning now to FIG. 5, an exemplary front plan view of the shoe sole portion painting system 400 of FIG. 4 is illustrated in accordance with aspects provided herein. Like numerals are used to indicate like elements. Some of the elements of the paint assembly 410 of FIG. 4 have been eliminated to better illustrate aspects associated with the masking assembly 412. FIG. 5 illustrates the outward-facing surface 425 of the front plate 424 of the mask cover 420, the air knife 422, and the fluid flow emitting portion 434. The outward-facing surface 425 of the front plate 424 may be defined by a top margin 510, a first side margin 512, a second side margin 514, and a bottom portion 516.

As shown in FIG. 5, the aperture 428 extends through the mask cover 420. The aperture 428 may be defined by a perimeter 429 extending through the front plate 424 of the mask cover 420. In an exemplary aspect, the aperture 428 may be aligned generally with the spray nozzle 414. More particularly, the aperture 428 may be aligned generally with the front port 416 of the spray nozzle 414 such that liquid material intended to be emitted through the front port 416 of the spray nozzle 414 would generally pass unobstructed through the aperture 428 while being obstructed by the rest of the front plate 424 of the mask cover 420.

The aperture 428 may in one exemplary aspect have a shape and placement as shown in FIG. 5. Specifically, the aperture 428 may have a shape in the general form of a semi-circle with the "edges" of the semi-circle intersecting with the bottom portion 516 of the front plate 424. However, other shape configurations and placements of the aperture 428 are contemplated as being within the scope herein. For example, instead of a semi-circular shape, the aperture 428 may be in the shape of a square, a rectangle, a half-oval, a half-ellipse, a half-diamond, and the like, each having edges intersecting the bottom portion 516 of the mask cover 420. As well, it is contemplated that the aperture 428 may not intersect the bottom portion 516 of the front plate 424 as shown in FIG. 5. For instance, the aperture 428 may be in the form of a whole circle, a whole ellipse, a whole diamond, and the like, each positioned, for example, in the middle of the mask cover 420, towards the bottom portion 516 of the mask cover 420, towards the top margin 510 of the mask cover 420, or towards either of the two side margins 512 and/or 514. The important thing in each of these cases is that the masking assembly 412 be positioned so that the aperture 428 is generally aligned with the front port 416 of the spray nozzle 414. As explained above, the fluid flow emitting portion 434 between the air knife 422 and the mask cover 420 may be used to transmit the pressurized laminar fluid flow emitted by the air knife 422 in an angled direction over the outward-facing surface 425 of the front plate 424 and in the direction of the aperture 428.

Figure 6:
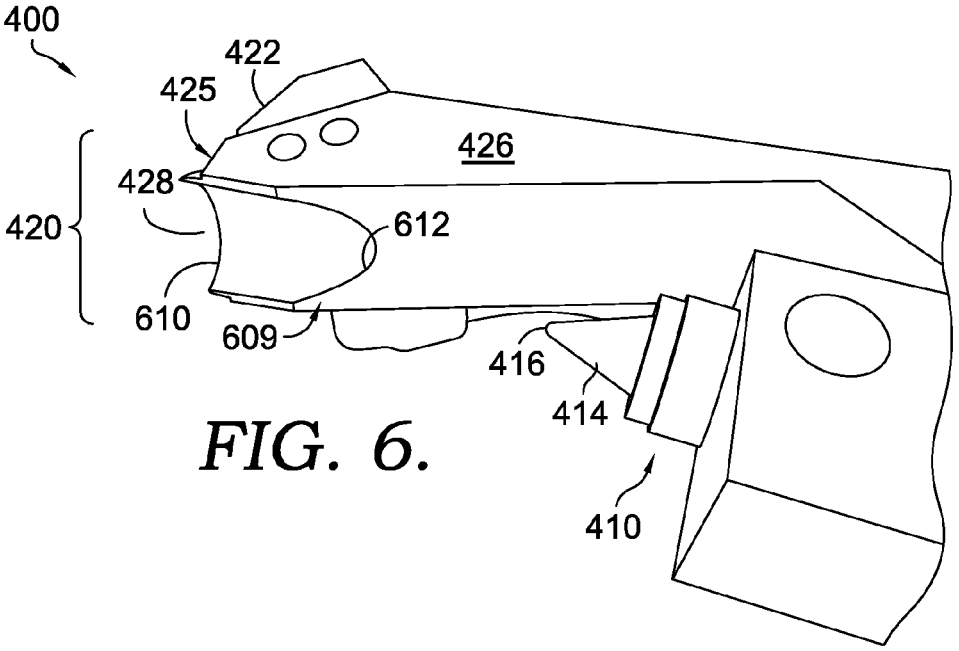
FIG. 6 illustrates a bottom perspective view of an exemplary shoe sole portion painting system depicting a paint assembly and a masking assembly for reference purposes in accordance with aspects hereof.

FIG. 6 illustrates an exemplary bottom perspective view of the shoe sole portion painting system 400 in accordance with aspects provided herein. As shown in FIG. 6, the aperture 428 extends through the mask cover 420 from the outward-facing surface 425 of the mask cover 420 through the inward-facing surface 609 of the mask cover 420. In an exemplary aspect, the shape of the aperture 428 may vary as the aperture 428 extends from the outward-facing surface 425 of the mask cover 420 through the inward-facing surface 609 of the mask cover 420. For instance, the aperture 428 may initially have a first shape (indicated by the numeral 610) at the outward-facing surface 425 of the mask cover 420 such as, for example, a semi-circle. The first shape 610 may gradually transition to a second shape (indicated by the numeral 612) as the aperture 428 extends through the inward-facing surface 609 of the mask cover 420, such as, for example, a half-ellipse. In other exemplary aspects, the shape of the aperture 428 may remain the same as the aperture 428 extends from the outward-facing surface 425 of the mask cover 420 through the inward-facing surface 609 of the mask cover 420. In other words, the first shape 610 may be the same as the second shape 612. Any and all such variations, and any combination thereof, are contemplated as being within the scope herein.

Figure 7:
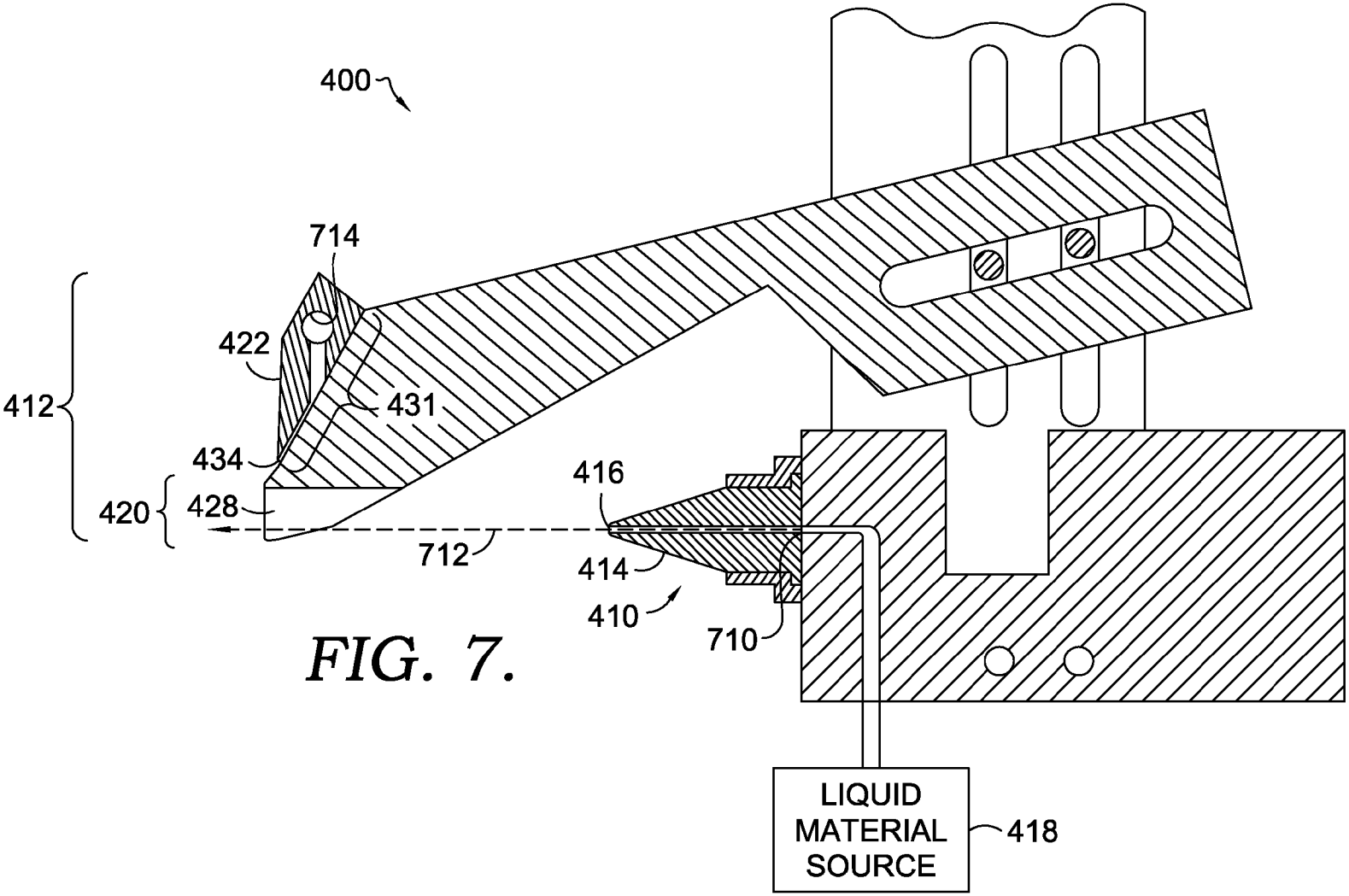
FIG. 7 illustrates a cross-sectional view taken along cut line 7-7 of FIG. 5 depicting an exemplary relationship between a spray nozzle of a paint assembly and an aperture of a masking assembly of a shoe sole portion painting system for reference purposes in accordance with aspects hereof.

Turning now to FIG. 7, FIG. 7 illustrates an exemplary cross-sectional view of the shoe sole portion painting system 400 taken along cut line 7-7 of FIG. 5 in accordance with aspects provided herein. FIG. 7 illustrates the paint assembly 410 comprising at least the spray nozzle 414 with its front port 416. As shown in FIG. 7, the spray nozzle 414 may further comprise the back port 710 that may be fluidly coupled to the liquid material source 418. A hypothetical axis 712 may be drawn from the back port 710 through the front port 416 of the spray nozzle 414 in the direction of the spray path of the intended emitted liquid material. The hypothetical axis 712 continues through the aperture 428 of the mask cover 420. Depending on the vertical position of the masking assembly 412, more specifically, the vertical position of the aperture 428 with respect to the front port 416 of the spray nozzle 414, the hypothetical axis 712 may extend through a lower portion of the aperture 428, a middle portion of the aperture 428, or an upper portion of the aperture 428. The important thing to note is that in each of the cases, the hypothetical axis 712 may extend through the aperture 428 such that a portion of the liquid material intended to be emitted by the front port 416 of the spray nozzle 414 is transmitted at least in part through the aperture 428.

The cross-sectional view in FIG. 7 further illustrates the positioning of the air knife 422 on the mask cover 420 and the configuration of the fluid flow emitting portion 434. Specifically, the air knife 422 may be positioned on the angled portion 431 of the mask cover 420. The fluid flow emitting portion 434 may be formed by the creation of a space or gap between the junction of the air knife 422 with the angled portion 431 of the mask cover 420. The fluid flow emitting portion 434 may be angled towards the direction of the mask cover 420 due to the angled portion 431 of the mask cover 420. A port assembly 714 fluidly coupled to, for example, the fluid source 432 of FIG. 4 may direct the pressurized fluid flow in the direction of the fluid flow emitting portion 434 where it may subsequently exit and flow over the outward-facing surface 425 of the mask cover 420.

Figure 8:
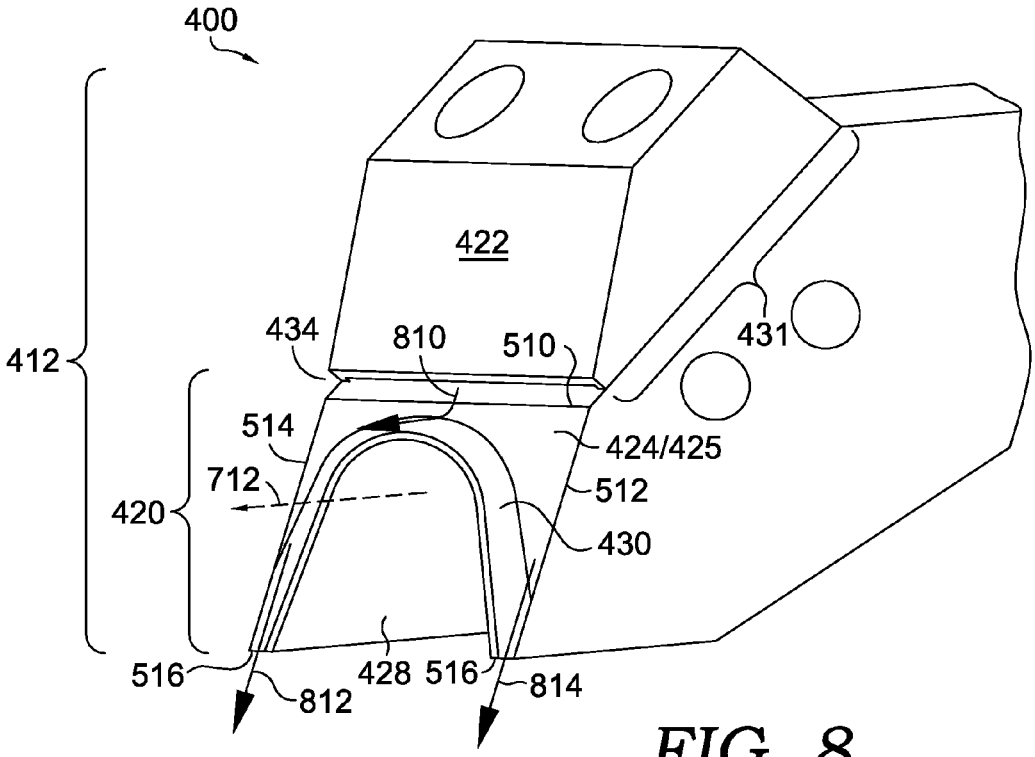
FIG. 8 illustrates a side perspective view of an exemplary laminar flow pattern of an air knife used in a masking assembly of a shoe sole portion painting system for reference purposes in accordance with aspects hereof.

FIG. 8 illustrates an exemplary laminar fluid flow pattern in accordance with aspects herein. FIG. 8 illustrates the masking assembly 412 comprising the mask cover 420 with its aperture 428 and surrounding flange 430, the air knife 422, and the fluid flow emitting portion 434 through which the laminar fluid flow is emitted. FIG. 8 further depicts the hypothetical axis 712 of FIG. 7 extending through the aperture 428.

Once the laminar fluid flow exits the fluid flow emitting portion 434 it may travel over the outward-facing surface 425 of the front plate 424 towards the hypothetical axis 712. When a portion of the fluid flow meets the superior margin of the flange 430 surrounding the aperture 428, it may be directed outward as indicated by the arrow 810. This helps to prevent deflection of liquid material in an upward or superior direction as it passes through the aperture 428. As indicated by the arrows 812 and 814, the remaining portion of the fluid flow continues to flow over the outward-facing surface 425 of the front plate 424 along the lateral margins of the flange 430 and in the direction of the bottom portion 516 of the mask cover 420. This flow pattern helps to limit lateral deflection of the liquid material as it passes through the aperture 428. As seen, the flange 430 serves a dual purpose. For example, it prevents the laminar fluid flow from impeding or disrupting the spray path of the liquid material as it passes through the aperture 428 (as shown by the hypothetical axis 712). Additionally, it directs the fluid flow in a manner that limits both lateral and superior deflection of the liquid material as it passes through the aperture 428. The combination of both results in a focused spray path of the liquid material allowing for a precise application of the liquid material to an object such as the shoe sole portion 200 of FIGS. 2 and 3.

Figure 9:
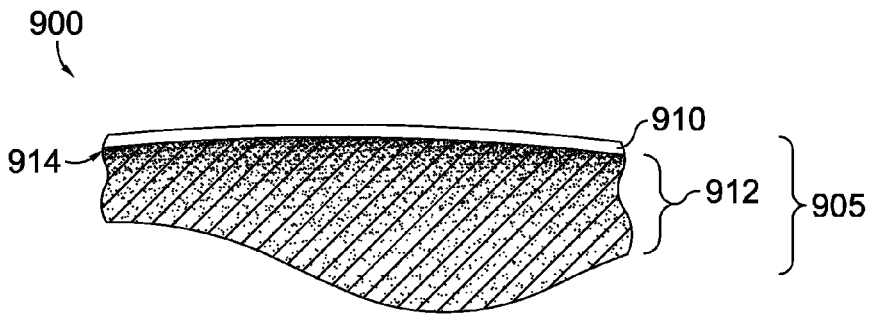
FIG. 9 illustrates an exemplary shoe sole portion painted by a shoe sole portion painting system for reference purposes in accordance with aspects hereof.

FIG. 9 depicts an exemplary shoe sole portion 900 that has been painted by the shoe sole portion painting system 400. More specifically, FIG. 9 depicts an exemplary segment of a side surface 905 of the shoe sole portion 900 in an upside-down configuration suitable for painting the side surface 905. The side surface 905 may include an unpainted lip or edge 910 that overhangs a painted generally concave portion 912. Although a concave portion is depicted in FIG. 9, other configurations are contemplated such as a convex portion, a planar portion, a partially convex and concave portion, and any other combination. The paint or liquid material is indicated by the hash marks in FIG. 9 and stippling is used to convey the concave nature of the concave portion 912. Use of the shoe sole portion painting system 400 with its mask cover 420 and air knife 422 enables a sharp paint line 914 to be created between the lip 910 and the generally concave portion 912. The crispness of the paint line 914 may be created in part when, for example, the laminar fluid flow emitted by the air knife 422 passes over the front plate 424 of the mask cover 420 and strikes the upper margin of the flange 430 such that the laminar fluid flow is directed in an outward direction as indicated by the arrow 810 of FIG. 8. This flow pattern helps to limit deflection of the liquid material on to, for example, the lip 910 of the shoe sole portion 900 (e.g., deflection of the liquid material in a superior direction) as it passes through the aperture 428. This may be particularly useful when a shoe sole portion has concave portions in combination with convex portions and/or planar portions such as shown by the shoe sole portion 900. Such configuration may cause paint particles to rebound off of the concave or convex portions and create unwanted paint speckling on areas of the shoe sole portion that are intended to be unpainted. Use of the air knife 422 in combination with the mask cover 420 helps to alleviate this concern.

Figure 10:
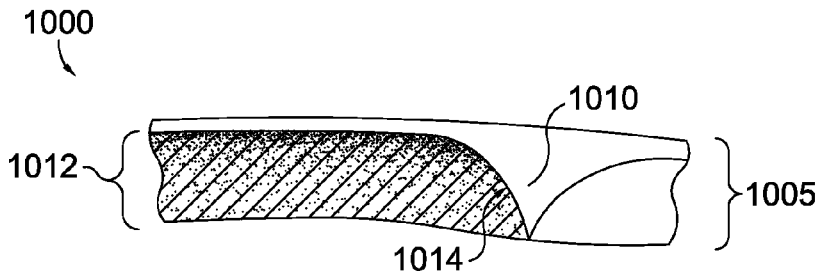
FIG. 10 illustrates an exemplary shoe sole portion painted by a shoe sole portion painting system for reference purposes in accordance with aspects hereof.

FIG. 10 depicts an exemplary shoe sole portion 1000 that has been painted by the shoe sole portion painting system 400. More specifically, FIG. 10 depicts a side surface 1005 of the shoe sole portion 1000 in an upside-down configuration suitable for painting the side surface 1005. The side surface 1005 may include an unpainted lip or edge 1010 that extends generally downward into a painted portion 1012. The paint or liquid material is indicated by the hash marks in FIG. 10 and stippling is used to convey the general three-dimensionality of the portion 1012. For example, the portion 1012 may be generally convex, concave, or planar with respect to the lip 1010. Use of the shoe sole portion painting system 400 with its mask cover 420 and air knife 422 enables a sharp paint line 1014 to be created between the downward protrusion of the lip 1010 and the portion 1012. The crispness of the paint line 1014 may be created in part when, for example, the laminar fluid flow emitted by the air knife 422 passes over the front plate 424 of the mask cover 420 and strikes the flange 430 along its lateral margins such that the laminar fluid flow is directed in a generally downward direction as indicated by the arrows 812 and 814 of FIG. 8. This flow pattern helps to limit deflection of the liquid material on to, for example, the downward extension of the lip 1010 of the shoe sole portion 1000 (e.g., deflection of the liquid material in a lateral direction) as it passes through the aperture 428. The result is that sharp paint lines can be achieved between laterally adjacent painted and unpainted areas of a shoe sole portion.

Figure 11:
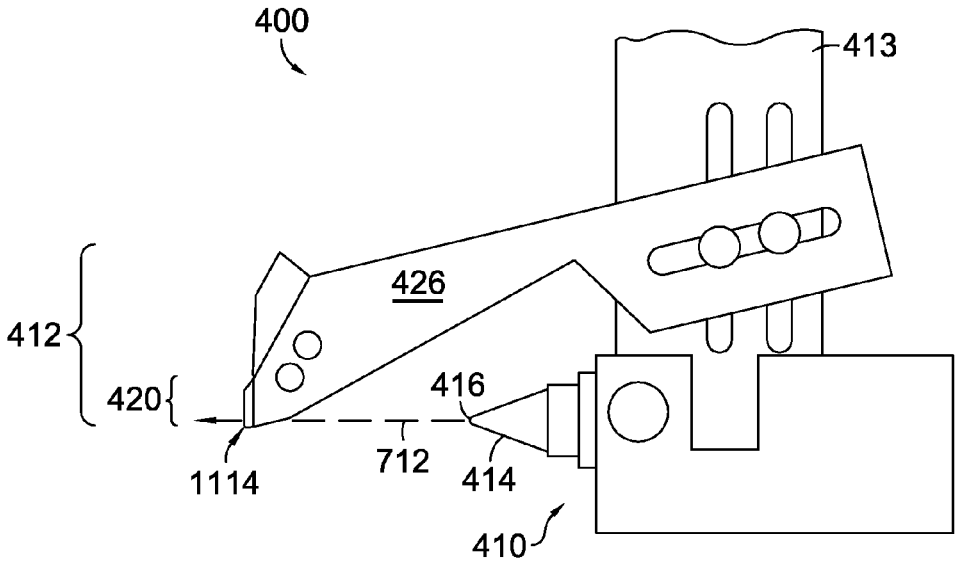
FIG. 11 illustrates a side plan view of an exemplary shoe sole portion painting system depicting a masking assembly in a fixed position for reference purposes in accordance with aspects hereof.

FIG. 11 depicts an exemplary side plan view of the shoe sole portion painting system 400 in accordance with aspects discussed herein. FIG. 11 is provided to illustrate how, in an exemplary aspect, the masking assembly 412 may be mechanically coupled to the paint assembly 410 in a fixed or non-moveable manner. In other words, the masking assembly 412 may be mechanically coupled to the paint assembly 410 such that the hypothetical axis 712 passes through the aperture 428 at a single fixed point as indicated by the numeral 1114. The arm 426 of the mask cover 420 may be fixed to the vertically-aligned plate 413 by one or more screws, bolts, rivets, welding and the like. The vertically-aligned plate 413, in turn, may be fixed to the paint assembly 410 via one or more screws, bolts, rivets, welding and the like. This configuration may fix the masking assembly 412 in position such that the hypothetical axis 712 extends through the aperture 428 at the single fixed point 1114.

Figure 12:
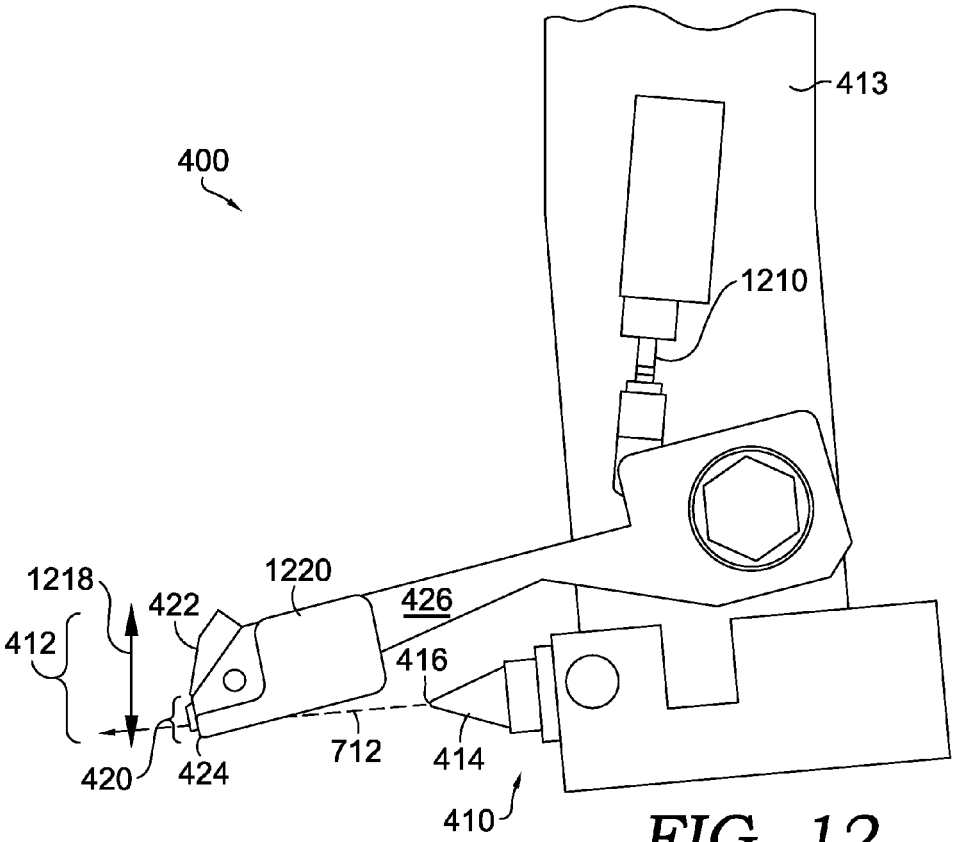
FIG. 12 illustrates a side plan view of an exemplary shoe sole portion painting system depicting a masking assembly having side panels and the masking assembly being coupled to an actuator that is adapted to move the masking assembly through a vertical range of motion for reference purposes in accordance with aspects hereof.

FIG. 12 depicts an exemplary side plan view of the shoe sole portion painting system 400 in accordance with aspects discussed herein. FIG. 12 is provided to illustrate how, in an exemplary aspect, the masking assembly 412 may be made to move through a vertical range of motion relative to the spray nozzle 414 such that the hypothetical axis 712 passes through the aperture 428 at one of several points along a vertical line. Movement of the masking assembly 412 through a vertical range of movement may be achieved by mechanically coupling the masking assembly 412 to an actuator 1210. In an exemplary aspect, the arm 426 may be mechanically coupled to the actuator 1210 by, for example, screws, bolts, rivets, welding, and the like. In an exemplary aspect, the actuator 1210 may be mechanically coupled to the vertically-aligned plate 413 using coupling technologies discussed herein. The vertically-aligned plate 413, in turn, may be mechanically coupled to the paint assembly 410 using the coupling technologies discussed herein.

When initiated, the actuator 1210 may move the masking assembly 412 through a vertical range of motion relative to the spray nozzle 414 as indicated by the bi-directional arrow 1218. More specifically, the front plate 424 of the mask cover 420 and its accompanying air knife 422 may be made to move through a vertical range of movement relative to the hypothetical axis 712 extending from the back port 710 of the spray nozzle 414 through the front port 416 of the spray nozzle 414. Because the hypothetical axis 712 is fixed and is representative of the direction of an intended spray path of the liquid material, movement of the front plate 424 of the mask cover 420 in an upward direction via the actuator 1210 may be effective to cause the mask cover 420 to obstruct less of the intended spray path of the liquid material. In other words, movement of the front plate 424 in an upward direction may be effective to cause more of the liquid material to be transmitted through the aperture 428. To explain it in yet another way, movement of the front plate 424 in an upward direction may be effective to cause the hypothetical axis 712 to pass through a lower portion of the aperture 428 (e.g., in the direction of the bottom portion 516 of the front plate 424).

Figure 13:
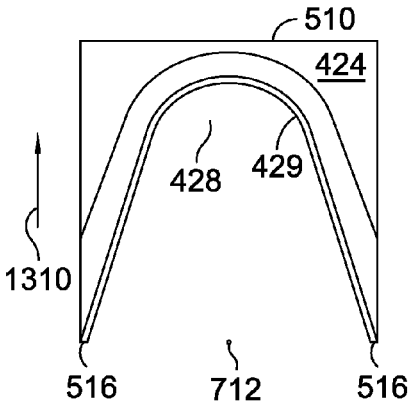
FIGS. 13-14 illustrate exemplary front plan views of the masking assembly of FIG. 12 depicting a position of a hypothetical axis indicative of an intended spray path for reference purposes in accordance with aspects hereof.

FIG. 13 helps to illustrate this exemplary aspect and is provided for reference purposes herein. FIG. 13 is a front plan view of just the front plate 424 of the mask cover 420 of the masking assembly 412. Arrow 1310 indicates that the mask cover 420 has been moved in an upward direction relative to the hypothetical axis 712 via, for example, the actuator 1210. Because the mask cover 420 has been moved upward, the hypothetical axis 712 is situated more towards the bottom portion 516 of the front plate 424. Because the hypothetical axis 712 is situated lower in the aperture 428, more of the liquid material transmitted by the front port 416 of the spray nozzle 414 may be able to be transmitted through the aperture 428. In other words, the mask cover 420 may be adapted to obstruct less of the liquid material intended to be transmitted by the spray nozzle 414.

In contrast, movement of the front plate 424 of the mask cover 420 in a downward direction via the actuator 1210 may be effective to cause the mask cover 420 to obstruct more of the intended spray path of the liquid material. In other words, movement of the front plate 424 in a downward direction may be effective to cause less of the liquid material to be transmitted through the aperture 428. To explain it in yet another way, movement of the front plate 424 in a downward direction may be effective to cause the hypothetical axis 712 to pass through an upper portion of the aperture 428 (e.g., in a direction towards the top margin 510 of the front plate 424).

Figure 14:
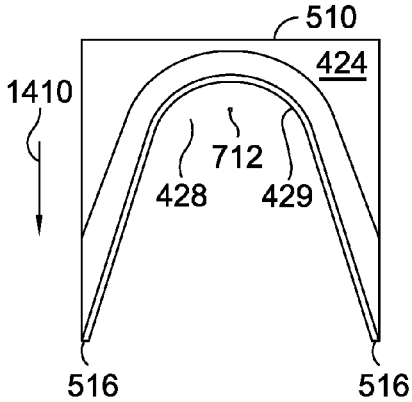

FIG. 14 helps to illustrate this exemplary aspect and is provided for reference purposes herein. FIG. 14 is a front plan view of just the front plate 424 of the mask cover 420 of the masking assembly 412. Arrow 1410 indicates that the mask cover 420 has been moved in a downward direction relative to the hypothetical axis 712 via, for example, the actuator 1210. Because the mask cover 420 has been moved downward, the hypothetical axis 712 is situated more towards the top margin 510 of the front plate 424. Because the hypothetical axis 712 is situated higher in the aperture 428, less of the liquid material intended to be transmitted by the front port 416 of the spray nozzle 414 may be able to be transmitted through the mask cover 420. In other words, the mask cover 420 may be adapted to obstruct more of the liquid material transmitted by the spray nozzle 414. As seen, movement of the front plate 424 of the mask cover 420 through a vertical range of movement via the actuator 1210 may cause the fixed hypothetical axis 712 to extend through the aperture 428 at any point along a vertical line.

In an exemplary aspect, the movement of the masking assembly 412 via the actuator 1210 may be programmably controlled. In some exemplary aspects, the actuator 1210 may be programmably-coupled to a robotic arm that controls the movement of the paint assembly 410 around an object. As the robotic arm moves the paint assembly 410 through a programmed range of movement around the object, the actuator 1210 may be programmed to move the masking assembly 412 through a vertical range of movement. As explained above, the movement of the masking assembly 412 may be effective to cause more or less of the liquid material emitted by the front port 416 of the spray nozzle 414 to pass unobstructed through the aperture 428. When the robotic arm is positioned to paint a larger area of the object, the actuator 1210 may be programmed to move the masking assembly 412 upward relative to the hypothetical axis, as shown in FIG. 13, so that the mask cover 420 may obstruct less of the liquid material and a greater amount of liquid material may be transmitted through the aperture 428. This helps to cover the larger area with fewer passes of the robotic arm. Conversely, when the robotic arm is positioned to paint a small area of the object, the actuator 1210 may be programmed to move the masking assembly 412 downward relative to the hypothetical axis 712, as shown in FIG. 14, causing the mask cover 420 to obstruct more of the intended spray path and causing a smaller amount of liquid material to be transmitted through the aperture 428. Both of these actions help to focus the spray path and to minimize overspray.

Returning to FIG. 12, in an exemplary aspect, the shoe sole portion painting system 400 may further comprise side panels 1220, one of which is shown in FIG. 12. The side panels 1220 may extend from the front plate 424 of the masking assembly 412 back towards the paint assembly 410. More specifically, the side panels 1220 may be mechanically coupled or fixed to the front plate 424 of the mask cover 420 and to the arm 426 of the mask cover 420. The side panels 1220 may extend downward in the direction of the hypothetical axis 712 and may be used, in an exemplary aspect, to limit spattering that may occur when the spray nozzle 414 is clogged.

Figure 15:
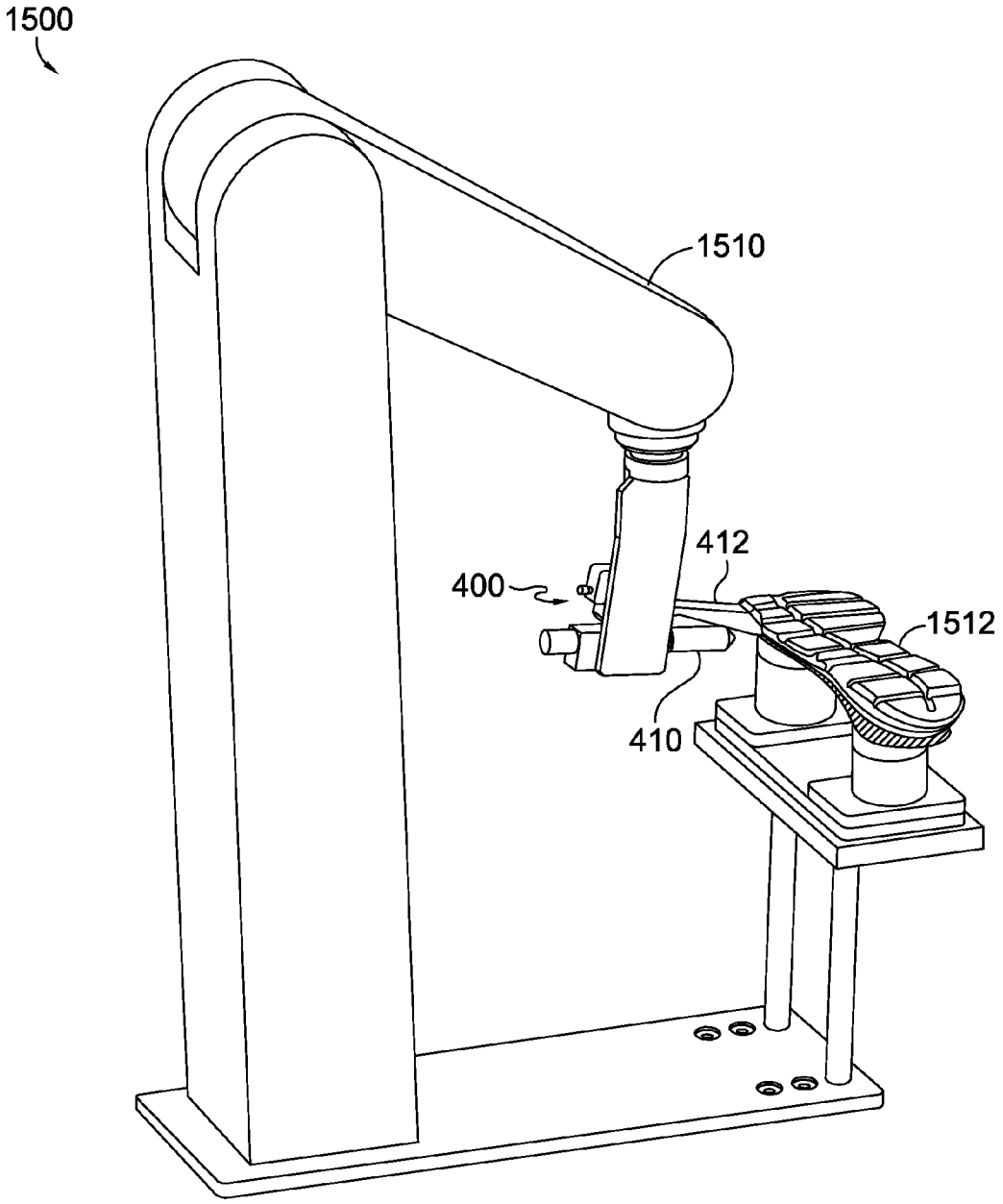
FIG. 15 illustrates a view of an exemplary shoe sole portion painting system in use to paint a shoe sole portion for reference purposes in accordance with aspects hereof.

FIG. 15 is an exemplary view of a shoe sole portion painting system being used to paint an object in accordance with aspects provided herein and is referenced generally by the numeral 1500. In an exemplary aspect, the shoe sole portion painting system referenced in FIG. 15 is the shoe sole portion painting system 400 discussed above. The shoe sole portion painting system 400 may be coupled to a moving mechanism 1510, such as a robotic arm, a human operator, a mechanical actuator, and the like, that may be used to move the painting system 400 in a predetermined path around, for example, a side surface (such as the side surface 212 of FIGS. 2-3) of a shoe sole portion 1512 that may be fixed in position. In an exemplary aspect, the shoe sole portion 1512 may be positioned in an "upside-down" arrangement where the upper surface (such as the upper surface 310 of FIG. 3) of the shoe sole portion 1512 may be positioned facing downward, and the lower surface (such as the lower surface 210 of FIG. 2) of the shoe sole portion 1512 may be positioned facing upward. Other ways of positioning the shoe sole portion 1512 are contemplated herein. For example, it is contemplated herein that the shoe sole portion 1512 may be fixed in a "rightside-up" configuration.

In an exemplary aspect, the moving mechanism 1510 may be adapted to position the shoe sole portion painting system 400 such that the distance between the front plate 424 of the mask cover 420 and the side surface of the shoe sole portion 1512 may be between 1 to 2 millimeters. More specifically, the moving mechanism 1510 may be adapted to position the shoe sole portion painting system 400 such that the distance between the edges of the flange 430 and the side surface of the shoe sole portion 1512 may be between 1 to 2 millimeters. Positioning the shoe sole portion painting system 400 at this distance further helps to limit diffusion of the liquid material emitted by the spray nozzle 414 as it passes through the aperture 428.

Further, in an exemplary aspect, the moving mechanism 1510 may be adapted to position the paint assembly 410 such that the spray nozzle 414 is angled in a slightly downward direction relative to the side surface of the shoe sole portion. In other words, the moving mechanism 1510 may be adapted to position the paint assembly 410 such that the hypothetical axis 712 (representing the direction of the spray path of the intended liquid material) extending from the back port 710 through the front port 416 of the spray nozzle 414 may form an angle of approximately 5 degrees (5°) from a line extending perpendicularly from the side surface of the shoe sole portion 1512. This angle is an approximation only and other angle measurements are contemplated herein such as for example, an angle measurement of 3 degrees, an angle measurement of 4 degrees, and angle measurement of 6 degrees, and the like. Additionally, this angle may be configurable depending on, for example, whether the paint assembly is making a first pass painting of the shoe sole portion 1512, a second pass painting of the shoe sole portion 1512, and the like. Positioning the paint assembly 410 such that the liquid material emitted by the paint assembly 410 strikes the side surface of the shoe sole portion 1512 at a downward angle may help to limit any overspray striking the upper surface of the shoe sole portion 1512.

Because the shoe sole portion painting system 400 is being used to achieve a controlled spray path, in an exemplary aspect, the side surface of the shoe sole portion 1512 may be left exposed. In other words, a mask may not be applied to the side surface of the shoe sole portion 1512 prior to painting.

As described above, the movement of the robotic arm 1510 around the shoe sole portion 1512 may be programmed using, for example, CAD data of a model of the shoe sole portion 1512. As well, the robotic arm 1510 may be programmed using vision scan data obtained from the shoe sole portion 1512. Other ways of programming the robotic arm 1510 are further contemplated as being within the scope herein.

The CAD data and/or the vision scan data may also be used, in an exemplary aspect, to program other parts of the shoe sole portion painting system 400. In an exemplary aspect, and as described above with respect to FIG. 12, an actuator such as the actuator 1210 may be programmed using the data from the shoe sole portion 1512 to move the mask cover 420 through a vertical range of movement relative to the hypothetical axis 712 extending from the back port 710 through the front port 416 of the spray nozzle 414. Thus, when data indicates there is a large area on the shoe sole portion 1512 that needs to be painted, the actuator 1210 may be programmed to move the mask cover 420 upward thereby causing a greater amount of liquid material to be transmitted through the aperture 428. This facilitates the robotic arm 1510 having to make fewer passes to paint the larger area. Alternatively, when data indicates there is a small area on the shoe sole portion 1512 that needs to be painted, the actuator 1210 may be programmed to move the mask cover 420 downward, thereby causing a lesser amount of liquid material to be transmitted through the aperture 428 in order to paint the smaller area.

Other components of the shoe sole portion painting system 400 may also be programmable. In an exemplary aspect, data from the shoe sole portion 1512 may be used to program, for example, the air knife 422 to vary the pressure of the laminar fluid flow emitted by the air knife 422. This may be useful, in exemplary aspects, when using a marking material such as paint to paint the shoe sole portion 1512. By varying the pressure of the fluid flow, a degree of color gradation can be achieved on the shoe sole portion 1512. For example, by decreasing the amount of pressure at which the laminar fluid flow is emitted by the fluid flow emitting portion 434 of the masking assembly 412, a greater amount of diffusion may be achieved as the paint passes through the aperture 428, thereby creating a less distinct paint line. This may be useful when trying to achieve color gradation. Conversely, by increasing the amount of pressure at which the laminar fluid flow is emitted by the fluid flow emitting portion 434, a lesser amount of lateral and/or superior diffusion may be achieved as the paint passes through the aperture 428, thereby creating a more distinct line without color gradation.

Figure 16:
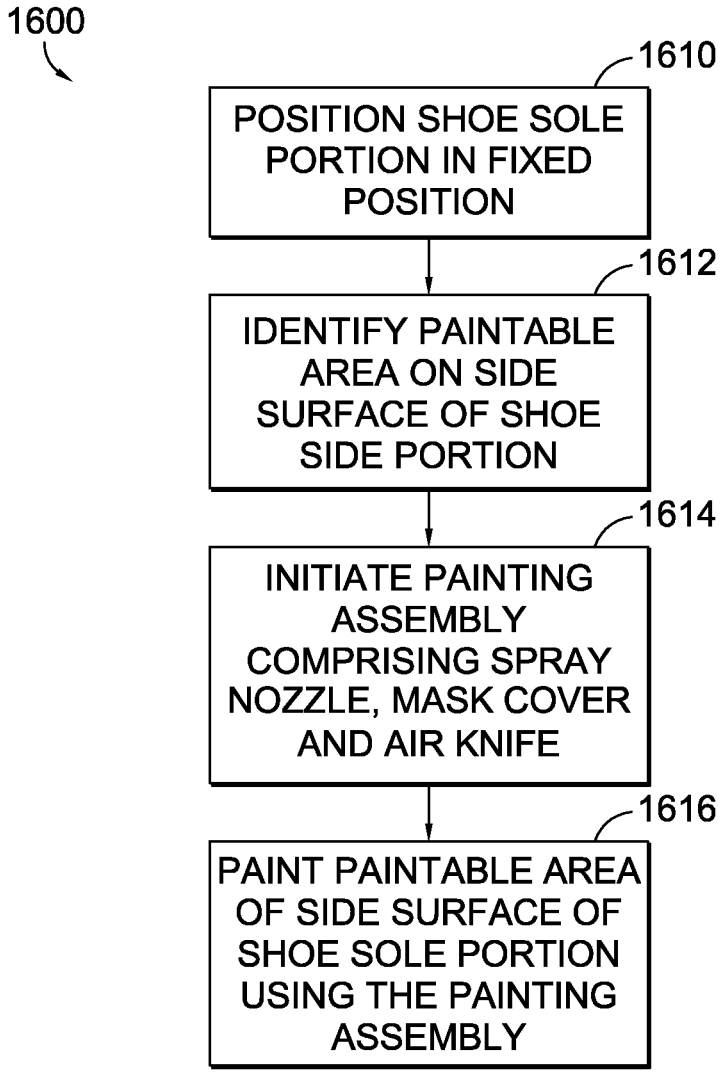
FIG. 16 illustrates an exemplary flow diagram of a method of painting a shoe sole portion using a shoe sole portion painting system for reference purposes in accordance with aspects hereof.

Turning now to FIG. 16, a flow diagram is depicted of an exemplary method 1600 of painting a shoe sole portion such as the shoe sole portion 1512 of FIG. 15. At a step 1610, the shoe sole portion may be fixed in position. In an exemplary aspect, the shoe sole portion may be generally fixed in position such that a side surface of the shoe sole portion may be exposed and is not masked or taped. In other words, a physical mask may not be applied to the side surface of the shoe sole portion either temporarily or permanently prior to painting the shoe sole portion.

At a step 1612, a paintable area on the side surface of the shoe sole portion may be determined or identified. In an exemplary aspect, this may be done using, for example, data from a CAD model of the shoe sole portion, and/or using vision scan data obtained from the shoe sole portion. The data may be used to program various components of the shoe sole portion painting system such as, for example, the robotic arm, the actuator (if utilized), and/or the air knife. In other exemplary aspects, the paintable area may be identified by a human operator. In other exemplary aspects, an unpaintable area on the side surface of the shoe sole portion may be determined or identified by a human operator, for example, using data from the CAD model or using vision scan data. This may be done in addition to identifying the paintable area, or this may be done in place of identifying the paintable area. Any and all such aspects, and any variation thereof, are contemplated as being within the scope herein.

At a step 1614, the shoe sole portion painting system may be initiated. As explained above, the shoe sole portion painting assembly may comprise a paint assembly and a masking assembly. The paint assembly may comprise at least a spray nozzle having a liquid-emitting front port and a back port coupled to a liquid material source. In an exemplary aspect, a hypothetical axis extends from the back port through the front port in the intended direction of the spray path. The paint assembly may further comprise the robotic arm that moves the paint assembly through a predetermined range of movement around the shoe sole portion.

The masking assembly of the shoe sole portion painting system may comprise, in an exemplary aspect, a mask cover and an air knife. The masking assembly may be fixed to the paint assembly and may remain fixed in position in one exemplary aspect, or may be made to move through a vertical range of movement relative to the hypothetical axis using an actuator in another exemplary aspect. The mask cover may be positioned at a predefined distance in front of the front port of the spray nozzle and may be adapted to partially obstruct the intended spray path of the liquid material. This may be accomplished by positioning the bottom portion of the mask cover in the intended spray path of the liquid material. In an exemplary aspect, the mask cover may comprise an aperture extending through the mask cover. The aperture may be positioned on the mask cover such that the hypothetical axis extending from the back port through the front port of the spray nozzle further extends through the aperture. The result of this is that at least a portion of the liquid material intended to be emitted by the front port of the spray nozzle may be transmitted unobstructed through the aperture. In an exemplary aspect, the aperture may be surrounded by a flange that extends perpendicularly outward from the mask cover.

The air knife may be coupled to the mask cover and may be adapted to emit a laminar fluid flow in an angled direction over the mask cover in the direction of the hypothetical axis. The flange surrounding the aperture helps to divert the fluid flow so that the liquid material may continue its passage through the aperture generally unobstructed. The laminar fluid flow not diverted by the flange continues in its angled direction and may act to limit any lateral and/or superior diffusion of the liquid material as it passes through the aperture so it does not reach the object.

At a step 1616, the paintable area on the shoe sole portion may be painted using the shoe sole portion painting system. To describe it in a different way, the shoe sole portion painting system may adapted to not paint the unpaintable area and to only paint the paintable area. In an exemplary aspect, this may be accomplished by moving the paint assembly through a predetermined range of movement around the shoe sole portion. As described herein, the shoe sole portion painting system is an automated painting system that is easy-to-use, provides consistent results, reduces waste, and lessens the reliance on a human operator.

Many different arrangements of the various components depicted, as well as components not shown, are possible without departing from the scope of the claims below. Aspects of our technology have been described with the intent to be illustrative rather than restrictive. Alternative aspects will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A shoe sole portion painting system comprising:

a paint assembly comprising at least a spray nozzle adapted to emit a liquid material from a front port of the spray nozzle; and a masking assembly comprising:

a mask cover coupled to the spray nozzle, the mask cover positioned at a predefined distance in front of the front port of the spray nozzle such that it partially obstructs the liquid material emitted by the spray nozzle, the mask cover having a top region and a bottom region, the mask cover comprising an aperture that extends through the mask cover, the aperture axially aligned with the front port of the spray nozzle; and an air knife coupled to the top region of the mask cover and adapted to project a laminar fluid flow in a generally angled direction towards the bottom region of the mask cover.

2. The shoe sole portion painting system of claim 1, wherein the spray nozzle is coupled to at least a liquid material source and a robotic arm.

3. The shoe sole portion painting system of claim 2, wherein the aperture is positioned at the bottom region of the mask cover, and wherein the aperture is defined by a perimeter.

4. The shoe sole portion painting system of claim 3, wherein at least a portion of the liquid material intended to be emitted by the front port of the spray nozzle is transmitted through the aperture.

5. The shoe sole portion painting system of claim 4, wherein a flange extends perpendicularly outward from the perimeter of the aperture.

6. The shoe sole portion painting system of claim 5, wherein the air knife projects the laminar fluid flow such that the fluid flow contacts at least the flange.

7. The shoe sole portion painting system of claim 1, wherein the mask cover is further coupled to an actuator.

8. The shoe sole portion painting system of claim 7, wherein the actuator actuates movement of the mask cover through a vertical range of motion relative to the spray nozzle.

9. A shoe sole portion painting system comprising:

a paint assembly comprising at least a spray nozzle having a front port and a back port, the spray nozzle adapted to emit a liquid material via the front port, wherein a hypothetical axis extends from the back port through the front port in an intended direction of the liquid material flow from the front port; and a masking assembly comprising:

a mask cover coupled to the paint assembly, the mask cover positioned in front of the front port of the spray nozzle such that the mask cover is effective to partially obstruct the liquid material intended to be emitted by the spray nozzle, the mask cover having an inward-facing surface and an outward-facing surface, wherein an aperture extends from the outward-facing surface through the inward-facing surface, and wherein the aperture is positioned on the mask cover such that the hypothetical axis extending from the back port of the spray nozzle through the front port of the spray nozzle extends through the aperture such that a portion of the liquid material intended to be emitted by the spray nozzle is able to be transmitted through the aperture; and an air knife coupled to the mask cover and adapted to emit a laminar fluid flow in a generally angled direction towards the direction of the hypothetical axis extending from the back port of the spray nozzle through the front port of the spray nozzle.

10. The shoe sole portion painting system of claim 9, wherein the spray nozzle is coupled to a liquid material source and to a robotic arm.

11. The shoe sole portion painting system of claim 9, wherein the mask cover is positioned between 4 to 10 centimeters in front of the front port of the spray nozzle.

12. The shoe sole portion painting system of claim 9, wherein the aperture is in the shape of a semi-circle.

13. The shoe sole portion painting system of claim 12, wherein the outward-facing surface of the mask cover comprises a flange extending perpendicularly outward from the aperture's edges.

14. The shoe sole portion painting system of claim 9, wherein the mask cover further comprises a first side panel extending from the mask cover back towards the spray nozzle and a second side panel extending from the mask cover back towards the spray nozzle.

15. The shoe sole portion painting system of claim 9, wherein the fluid flow is emitted at a fixed pressure by the air knife.

16. The shoe sole portion painting system of claim 9, wherein the fluid flow is emitted at a variable pressure by the air knife.

* * * * *